US011424577B2

(12) United States Patent
Kliever

(10) Patent No.: US 11,424,577 B2
(45) Date of Patent: Aug. 23, 2022

(54) HIGH-CURRENT ELECTRICAL CONNECTOR AND ELECTRICAL CONNECTOR SYSTEM

(71) Applicant: HARTING Electric GmbH & Co. KG, Espelkamp (DE)

(72) Inventor: Wilhelm Kliever, Minden (DE)

(73) Assignee: HARTING Electric Stiftung & Co. KG, Espelkamp (DE)

( * ) Notice: Subject to any disclaimer, the term of this patent is extended or adjusted under 35 U.S.C. 154(b) by 0 days.

(21) Appl. No.: 17/280,357

(22) PCT Filed: Oct. 30, 2019

(86) PCT No.: PCT/DE2019/100934
§ 371 (c)(1),
(2) Date: Mar. 26, 2021

(87) PCT Pub. No.: WO2020/094181
PCT Pub. Date: May 14, 2020

(65) Prior Publication Data

US 2022/0037835 A1 Feb. 3, 2022

(30) Foreign Application Priority Data

Nov. 7, 2018 (DE) ..... 10 2018 127 720.2

(51) Int. Cl.
*H01R 13/64* (2006.01)
*H01R 13/627* (2006.01)

(52) U.S. Cl.
CPC ..... *H01R 13/64* (2013.01); *H01R 13/6278* (2013.01)

(58) Field of Classification Search
CPC ..... H01R 13/6278; H01R 13/64; H01R 13/6456; H01R 13/207; H01R 2103/00; H01R 2101/00
USPC ..... 439/372, 157, 680, 677, 681, 313, 320, 439/805, 810, 378
See application file for complete search history.

(56) References Cited

U.S. PATENT DOCUMENTS 4,361,375 A * 11/1982 Bailey ..... H01R 13/6395 439/352
4,500,946 A * 2/1985 Mikola ..... F21S 41/192 362/267

(Continued)

FOREIGN PATENT DOCUMENTS

CN 104779488 A * 7/2015
DE 10140177 A1 4/2003

(Continued)

*Primary Examiner* — Marcus E Harcum
(74) *Attorney, Agent, or Firm* — Smartpat PLC

(57) ABSTRACT

A high-current electrical connector (1) is codable for use with a certain mating electrical connector and flexibly and comfortably adaptable to the conditions of a tight installation space in which the high-current electrical connector is used. The insulating body (14) of the high-current electrical connector is retained on the pin contact (11) such that said insulating body can be rotated about the pin axis (S). Thus, the mating electrical connector (4) connected thereto, coded therefor and aligned therewith can be rotatably retained such that the angled cable outlet (42) of the mating electrical connector can be flexibly oriented within the installation space as required.

16 Claims, 7 Drawing Sheets

(56) References Cited

U.S. PATENT DOCUMENTS 4,682,847 A * 7/1987 Moore ..... H01R 13/62933 439/372
4,840,574 A * 6/1989 Mills ..... H01R 13/66 439/378
4,955,823 A * 9/1990 Luzzi ..... H01R 13/53 439/805
6,099,342 A * 8/2000 Letourneau ..... H01R 13/193 439/372
6,142,787 A * 11/2000 Ikesugi ..... H01R 13/62933 439/372
6,217,354 B1 * 4/2001 Fencl ..... H01R 13/62977 439/372
6,220,902 B1 * 4/2001 Ivandic ..... F16G 11/048 439/727
6,227,914 B1 * 5/2001 Lee ..... H01R 4/307 439/957
6,957,971 B2 * 10/2005 Wu ..... H01R 13/622 439/680
7,097,514 B2 * 8/2006 Ishizaki ..... H01R 24/542 439/681
7,318,755 B2 * 1/2008 Sauer ..... H01R 13/645 439/680
7,326,091 B2 * 2/2008 Nania ..... H01R 13/6599 439/681
7,413,478 B2 * 8/2008 Kleinschmidt ..... H01R 13/652 439/737
7,422,486 B2 * 9/2008 Hoff ..... G06F 3/023 439/655
7,467,979 B2 * 12/2008 Colescott ..... H01R 4/5091 439/805
7,717,723 B2 * 5/2010 Nehm ..... H01R 13/62966 439/372
7,749,016 B2 * 7/2010 Ikeya ..... H01R 13/621 439/364
7,931,486 B1 * 4/2011 Walters ..... H01R 13/642 439/320
8,251,762 B2 8/2012 Maier et al.
9,124,050 B2 * 9/2015 Siebens ..... H01R 13/207
9,166,329 B2 * 10/2015 Eckel ..... H01R 13/533
9,837,761 B1 12/2017 Hardy et al.
10,122,117 B2 * 11/2018 Miller ..... H01R 13/6271
10,243,298 B2 * 3/2019 Kawai ..... H01R 13/5829
10,320,110 B2 * 6/2019 Loetkemann ..... H01R 13/516
10,739,833 B2 * 8/2020 Chai ..... G06F 1/203
2002/0028607 A1 * 3/2002 Babel ..... H01R 13/5202 439/680
2011/0177715 A1 * 7/2011 Buck ..... H01R 13/74 439/544
2011/0269331 A1 * 11/2011 Saber ..... H01R 13/629 439/372
2013/0323954 A1 12/2013 Eckel et al.
2015/0004852 A1 * 1/2015 Hildebrand ..... H01R 4/34 439/810
2018/0026408 A1 1/2018 Ensley et al.
2018/0241147 A1 8/2018 Loetkemann et al.
2018/0261954 A1 9/2018 Zebhauser et al.
2019/0190200 A1 * 6/2019 Chang ..... H01R 13/6275

FOREIGN PATENT DOCUMENTS

DE 102007052606 6/2009
DE 102004041809 9/2010
DE 102011004347 A1 8/2012
DE 102015113786 A1 2/2017
DE 102017121312 A1 3/2018
DE 102017000102 A1 7/2018
WO 2016131526 A1 8/2016
WO WO-2017158577 A1 * 9/2017

* cited by examiner

HIGH-CURRENT ELECTRICAL CONNECTOR AND ELECTRICAL CONNECTOR SYSTEM

TECHNICAL FIELD

The disclosure relates to a high-current plug connector and to a high-current plug connector system, having a high-current plug connector and a mating plug connector.

BACKGROUND

High-current plug connectors can be used particularly advantageously with a mating plug connector—which has, in particular, an angled cable outlet—for example in the form of a high-current plug connector system. To prevent mismatings, the high-current plug connector and the mating plug connector can be coded as corresponding to one another. Such a high-current plug connector system is required, for example, to connect a correspondingly heavy-duty stranded conductor to a battery, e.g. for supplying an electric current to an electric motor in an electric car. The high-current plug connector conventionally has a mounting housing, an insulating body and a plug contact with which it can be electrically and mechanically connected to a busbar. For example, more than 25 A (amperes), in particular more than 75 A, for example 150 A and more, can be transmitted via the plug contact of the high-current plug connector.

In the prior art, a single-pole, angled plug connector is known from printed document DE 10 2015 113 786 A1, which plug connector has a plug connector housing, an insulating body and a contact. In this case the plug connector has a rectangular design and is designed for assembly on an appliance wall or other surface. The associated contact element likewise has a rectangular and one-piece design. A two-part insulating body is required for assembly of the plug connector, which insulating body is assembled in the plug connector installation housing from two directions.

Building on this, printed document DE 10 2011 004 347 A1 proposes a multi-pole electrical connector. This electrical connector serves to establish a plug-in connection with the mating connector. The electrical connector has a housing and a seal arranged on the housing. The connector can have a line outlet which is angled through 90□ in order to reduce the spatial requirement. A high-voltage plug connector system is furthermore disclosed. This comprises such an electrical connector and a mating connector which can be mated with the electrical connector. The high-current plug connector system can be, in particular, a high-voltage or HV high-current plug connector system, which can be used in hybrid, battery and/or fuel cell vehicles and with which high-voltage lines can be electrically connected to devices such as batteries, electric motors, etc., for example. The mating connector also has raised portions formed on the base part and extending beyond the underside, with which a "coding" of the mating connector can be realized so that the mating connector can only be screwed onto certain devices (having recesses associated with the raised portions) and/or screwed onto a device in a particular alignment, for example.

Printed document WO 2016/131526 A1 discloses an angled high-current plug connector having an internal conductor contact for carrying a current, an external conductor part and an insulator part, which holds the internal conductor contact at a spacing from the external conductor part. An elastically compressible damping element is provided on the plug connector. This damping element can be elastically compressed when a complementary mating plug connector is plugged into the plug connector and thereby reduces the mobility of the insulator part with respect to the internal conductor contact.

In the high-voltage range, it is particularly important to be able to code plug connectors as corresponding to one another in order to prevent dangerous mismatings. This is disadvantageous in that, with the conventional codings, the direction of a possibly angled cable outlet of the mated mating plug connector is defined automatically. This is linked to an increase in problems and/or undesired costs during installation in and/or on specified appliances, e.g. in engine compartments, machines and/or systems etc., owing to the predetermined and usually confined spatial conditions there.

SUMMARY

An object of the disclosure is to provide a high-current plug connector, which can be coded for use with a certain mating plug connector, whilst being flexibly and conveniently adaptable to the conditions of the installation space in which it is used.

This object is achieved by the features of the independent claims. Advantageous configurations of the invention are revealed in the subclaims.

A high-current plug connector is provided for installing and/or mounting in or on an electrical device, in particular on a busbar of this device, and for mating with a mating plug connector and for transmitting electrical energy to the mating plug connector.

The high-current plug connector has an insulating body. The insulating body has a polarization element for defining the alignment of the mating plug connector on the insulating body, and a coding element for preventing mismatings. In particular, the coding element can realize a certain coding via its position relative to the polarization element.

The high-current plug connector has a plug contact arranged in its insulating body and having a mating axis, wherein the plug contact has a plug-in region at a first end and, opposite this, a connection region with a screw thread, in particular an external thread, at a second end. The plug contact is preferably a pin contact.

The mounting housing and the plug contact, in particular the pin contact, can each be fixed on the electrical device and the plug contact can be additionally electrically contacted thereby. In particular, the plug contact, in particular the pin contact, can be fixed on a busbar of the electrical device and electrically contacted thereby. For example, the plug contact can be screwed into an internal thread of a cylindrical through-opening of the busbar by means of its screw thread, which is preferably an external thread. Alternatively or additionally, the plug contact can be guided with its external thread through a threadless, cylindrical through-opening of a busbar and tightly screwed thereon by means of one or two screw-nuts, e.g. on both sides. However, the insulating body is at the same time held on the plug contact and possibly also in the mounting housing such that it is rotatable about the mating axis.

As already mentioned, the plug contact can be, in particular, a pin contact. The plug-in region of the pin contact can then be formed by a contact pin. The mating plug connector can then have a matching socket contact as a mating plug contact, which socket contact has a contact socket. To transmit the said electrical energy, a current of 25 A (amperes), in particular more than 75 A, for example more than 100 A or even 150 A and more, can flow via the plug contact and the mating plug contact.

In a particularly preferred configuration, the high-current plug connector has a mounting housing, which can be fixed on the electrical device, wherein the insulating body is arranged in the mounting housing and is held therein such that it is rotatable about the plug contact axis.

The novel connector is particularly advantageous since not only is the insulating body consequently held on the electrical device such that it is rotatable about the mating axis, but also the coded mating plug connector, which is mated therewith and aligned on the insulating body. If the mating plug connector has an angled cable outlet, this cable outlet can also be variably rotated in any desired direction in the installed and mated state owing to the said rotatability of the insulating body in a plane perpendicular to the mating direction. This is particularly advantageous when the high-current plug connector is installed in or on the electrical device, e.g. a machine or an appliance or an engine compartment or in any other installation space in which the spatial conditions call for a flexible alignment.

For example, if the plug contact is screwed into or onto the said busbar of the electrical appliance on the connection side by means of its screw thread for fastening purposes and for establishing the electrical connection, the cable outlet of the mating plug connector connected thereto can be rotated about the plug contact axis relative to the busbar, i.e. relative to the electrical appliance. The cable outlet can consequently point in any desired direction which lies in a plane which is at a right-angle to the plug contact axis. This results in particularly good flexibility, especially in a particularly confined or otherwise restricted installation space. In particular, the operation is designed to be particularly convenient since, to this end, the mating plug connector merely has to be rotated manually in the desired direction. Therefore, this does not require a screw and/or a screw-nut to be unfastened and then re-fastened after altering the position of the mounting housing. At the same time, the coding is maintained so that mismatings are furthermore prevented.

The coding can be realized in particular by defining the relative position between the coding element and the polarization element of the insulating body.

In a preferred configuration, the insulating body can have a circumferential collar and a cavity enclosed thereby. The plug contact, in particular the pin contact, can project into this cavity with its plug-in region, in particular with its contact pin.

The otherwise hollow cylindrically designed collar of the insulating body of the high-current plug connector can have, as a polarization element on a certain portion, namely a polarization portion, a polarizing form which deviates therefrom and which defines the alignment of the mating plug connector possibly mated therewith on the insulating body. The polarization portion can therefore extend in a flattened manner, for example; in other words, the collar can be designed to be planar in the polarization portion, whereas it otherwise has a hollow cylindrical configuration.

The insulating body can have a coding molding as a coding element on its circumferential collar. The coding molding can realize the said coding via its position relative to the polarization element, in particular relative to the polarization portion. For example, the coding molding can be arranged opposite the polarization element on the circumferential collar.

The mating plug connector can have a matching coding recess on a mating insulating body as a mating coding element, which coding recess, through its form and its position, corresponds to the coding molding of the collar during the mating procedure and cooperates therewith in a coding manner.

The mating insulating body of the mating plug connector can furthermore have a mating polarization element. In particular, at least in some portions, namely by means of a mating polarization portion, it can be inserted into the collar of the insulating body in a precisely fitting manner, with its form complementing the polarization portion of the insulating body.

In other words, the mating insulating body can therefore likewise have a matching flattened portion, namely the said mating polarization portion, which corresponds to the polarization portion of the circumferential collar of the insulating body and cooperates with this in an aligned manner during mating. It is thus possible to define the alignment of the mating plug connector on the insulating body in the mated state.

Apart from this mating polarization portion, the mating plug connector can have a cylindrical design in its mating plug-in region.

For example the coding recess of the mating plug connector can be arranged opposite its mating polarization portion on the mating insulating body.

The mating insulating body can consequently be inserted into the circumferential collar of the insulating body, in particular in a form-fitting manner, at least in part, namely by means of a mating portion.

If the coding recess of the mating plug connector and the coding molding of the high-current plug connector are in the same position relative to the respective polarization portion and the mating polarization portion, the mating procedure can take place. Alternatively, the high-current plug connector and the mating plug connector do not fit together and the mating procedure is automatically prevented.

The plug contact, in particular the pin contact, can preferably be made of metal. In particular, it can be a turned part.

The plug contact, in particular the pin contact, can have a recess, in particular a circumferential groove, in its plug-in region, in particular its contact pin, in which groove a contact spring, in particular a circumferential helical spring, is arranged for electrical contacting of the mating plug contact, in particular the socket contact, of the mating plug connector.

For electrical safety, the plug contact, in particular the pin contact, can have touch protection at the free end of its plug-in region, in particular its contact pin, which touch protection consists of an electrically insulating material, in particular plastic.

The plug connector housing can have a mounting flange for fastening it in place. For example, it can be fastened on a housing of the electrical appliance by means of this mounting flange.

The high-current plug connector can advantageously be designed with a single pole, i.e. it can have precisely one plug contact.

As already mentioned, the connection-side screw thread of the plug contact can be an external thread. By means of this external thread, the plug contact of the high-current plug connector can be screwed into or onto the busbar of the electrical device and thus be mechanically fixed thereon and at the same time electrically contacted thereby.

During the procedure of screwing the plug contact into an internal thread of the busbar by means of the external thread, the exact alignment of the plug contact may often not be precisely defined. The alignment of the plug contact and the mounting housing relative to the busbar is then defined in an arbitrary manner. However, irrespective of this, the angled cable outlet of the mating plug connector mated therewith can still be advantageously aligned in the desired direction since the mating plug connector is ultimately aligned on the rotatably held insulating body of the high-current plug connector.

The high-current plug connector system has the high-current plug connector and the mating plug connector, wherein the mating plug connector has the said angled cable outlet.

As already mentioned, the high-current plug connector and the mating plug connector have a common coding via which they are defined as corresponding to one another and being mateable with one another. Conversely, further mating plug connectors can also exist, which have a different coding and are therefore not mateable with the high-current plug connector. This is advantageous in that mismatings, i.e. plug connections which are defined as undesired, can be prevented.

To this end, the mateability and the alignment of the angled cable outlet of the mating plug connector can also be defined by the relative position of its mating coding element and its mating polarization element on the insulating body of the high-current plug connector. As a result of the rotatability of the insulating body relative to the mounting housing, the cable outlet of the mating plug connector aligned on the insulating body can be held on the high-current plug connector such that is rotatable about the plug contact axis, i.e. in a variable manner.

An exemplary embodiment of the invention is illustrated in the drawings and will be explained in more detail below.

DETAILED DESCRIPTION

The figures contain partially simplified, schematic illustrations. Identical reference signs are sometimes used for elements which are similar, but possibly not identical. Different views of similar elements could be drawn to different scales.

Figure 1A:
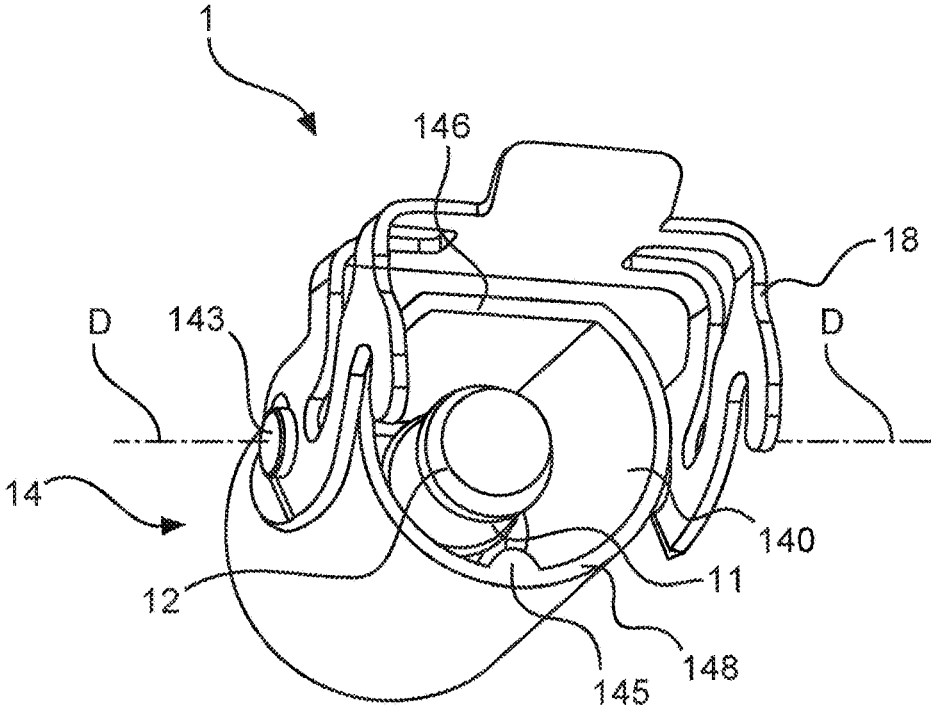
FIG. 1*a* shows a high-current plug connector without a mounting housing, with an insulating body with a circumferential collar, an inserted pin contact and a locking clip.

FIG. 1*a* shows a high-current plug connector 1 having an insulating body 14. The insulating body 1 has a circumferential collar 148, by means of which a cavity 140 is formed. A plug contact in the form of a pin contact 11 is furthermore held in the insulating body 14 such that it is rotatable about its pin axis S. Conversely, the insulating body 14 is therefore held on the plug contact 11 such that it is rotatable about the pin axis S. The plug contact 11 is a high-current contact and can transmit currents of 10 A (amperes) and more, for example.

In a respectively different embodiment, however, the plug contact could also be a socket contact, a hermaphroditic contact or any other plug contact which is capable of transmitting currents of 10 A and more, for example.

The high-current plug connector 1 furthermore has a locking clip 18, which is held on the circumferential collar 148 of the insulating body 14 such that it can swivel about an axis of rotation D, wherein the axis of rotation D extends perpendicularly to the pin axis S. As a result of this swiveling movement, a mating plug connector 4 mated with the high-current plug connector 1 can be locked on the high-current plug connector 1. In the present example, the locking clip 18 is held on two mutually opposing pivot pins 143 such that it is rotatable about the axis of rotation D.

The circumferential collar 148 has a polarization element in the form of a planar polarization portion 146, which is provided for the alignment of the mating plug connector 4 mated therewith. The circumferential collar 148 has a planar form in the region of this polarization portion 146. Situated opposite, i.e. at an angular spacing of 180°, the insulating body 14 has, on its circumferential collar 148, a coding element in the form of a coding molding 145, which is directed inwards, i.e. projecting into the cavity 140.

Figure 1B:
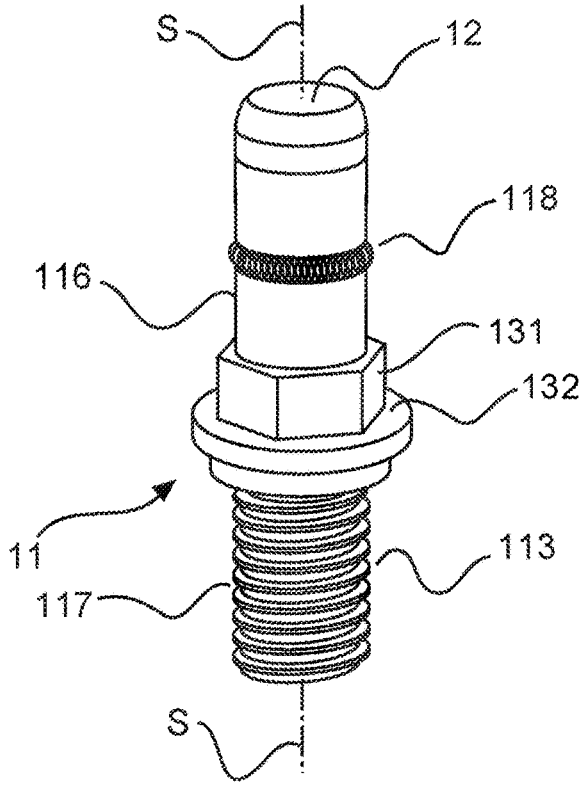
FIG. 1*b* shows the pin contact as a separate component.

The pin contact 11 is illustrated again separately in FIG. 1*b*. The pin axis S shown in this illustration is formed by the axis of symmetry of the pin contact 11 in this case.

The pin contact 11 has a circumferential groove (not shown in more detail) in its plug-in region which is designed as a contact pin 116, in which groove a contact spring in the form of an annularly designed helical spring 118 is arranged for electrical contacting of a contact socket 411 of the mating plug connector 4.

At the free end of its plug-in region designed as a contact pin 116, touch protection 12 made of plastic material is fastened on the pin contact 11 for electrical safety.

At the opposite end, the pin contact 11 has a connection region 117 having a screw thread designed as an external thread 113 for screwing it into or onto a busbar (not illustrated in the drawing) of an electrical device of the like.

Between the plug-in region/contact pin 116 and the connection region having the external thread 113, the plug contact 11 has a plate-shaped separating collar 132 and a screw-nut portion 131. The latter serves, for example, for manually screwing the external thread 113 into an internal thread of the busbar by means of a wrench or for securing ("locking") the pin contact 11 in the case of a comparable screw-fastening or assembly procedure.

Figure 2A:
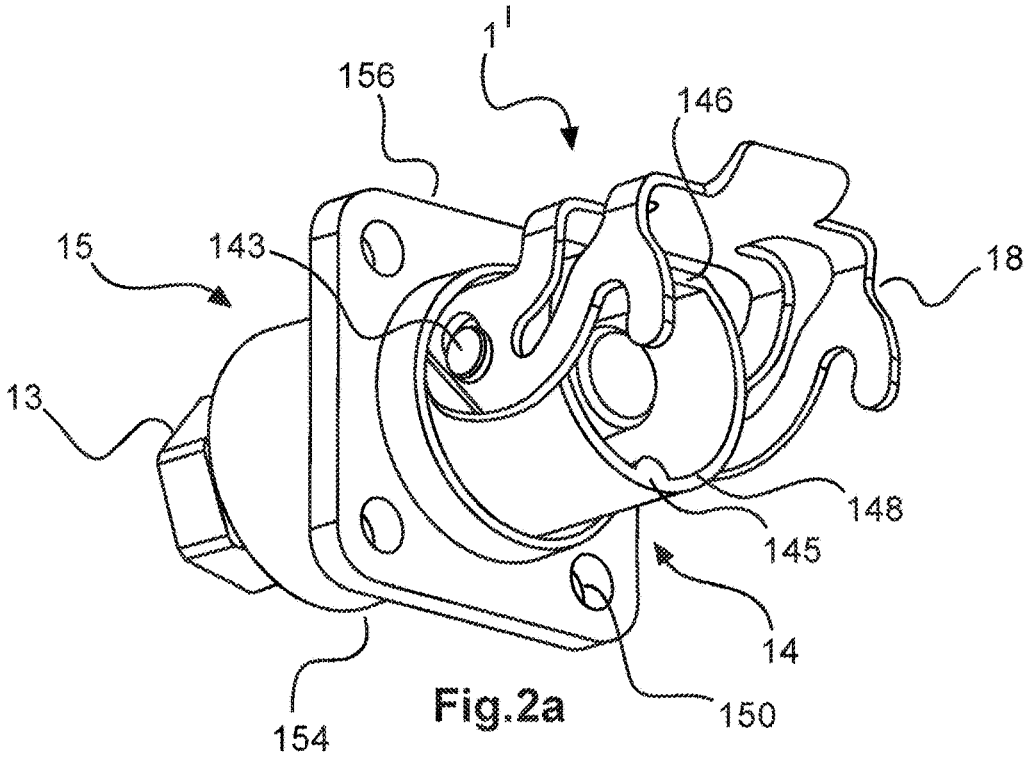
FIGS. 2*a*, 2*b* show a further high-current plug connector with a mounting housing in an oblique plan view and in a cross-sectional illustration.
Figure 2B:
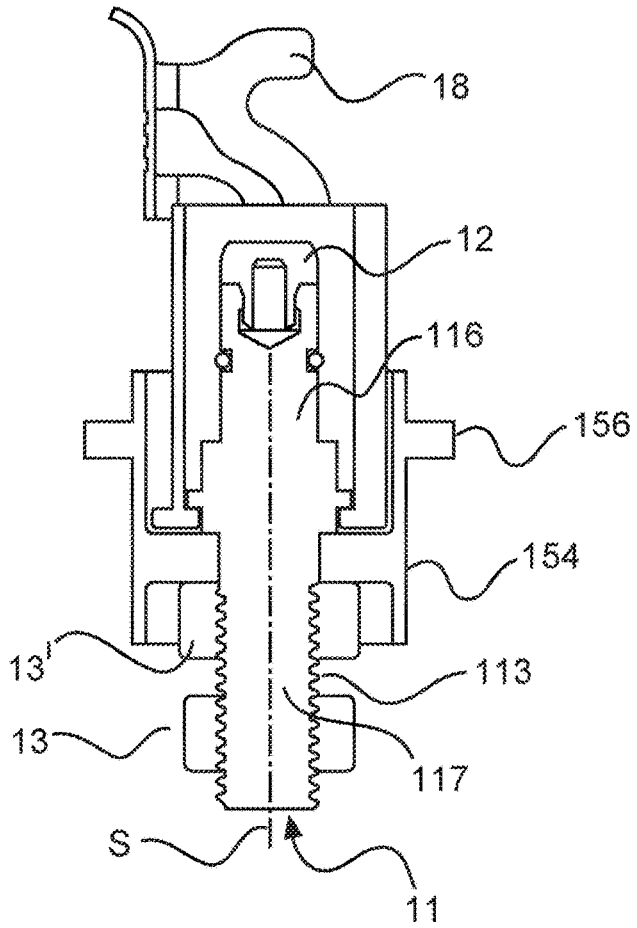

FIG. 2 shows a further high-current plug connector 1', which largely corresponds to the above-mentioned high-current plug connector 1, but is additionally fitted with a mounting housing 15. FIG. 2*a* shows this high-current plug connector 1' in an oblique plan view. FIG. 2*b* shows it in a cross-sectional illustration.

The mounting housing 15 has a hollow cylindrical sleeve 154, into which the insulating body 145 is inserted. In this case, the insulating body 14 is held in the mounting housing 15 such that it is rotatable about the pin axis S.

The mounting housing 15 furthermore has a fastening flange 156 with screw passages 150 for fastening purposes, e.g. for fastening on a device housing of the electrical device (not illustrated in the drawing).

Furthermore arranged on the external thread 113 of the connection region 117 of the pin contact 11 are two screw-nuts 13, 13' with which the pin contact 11, for example, of the busbar of the said electrical device can be screwed and thus fastened thereon and electrically contacted thereby.

Figure 3A:
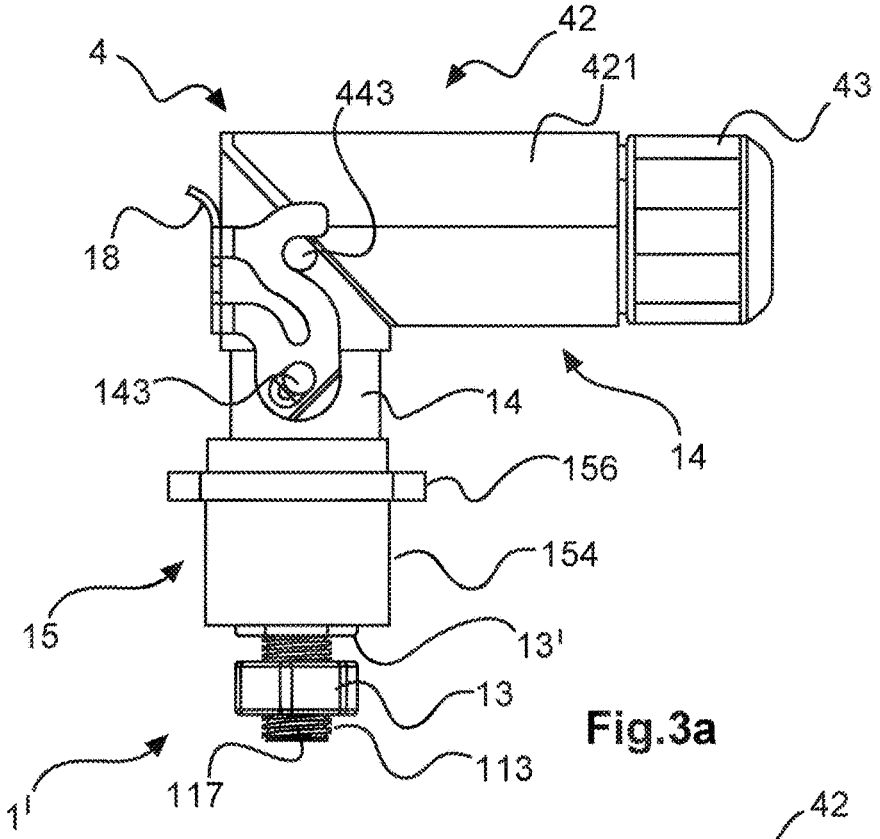
FIGS. 3*a*, 3*b* show a mated high-current plug connector system, having the high-current plug connector and a mating plug connector in a side view and as a cross-sectional illustration.
Figure 3B:
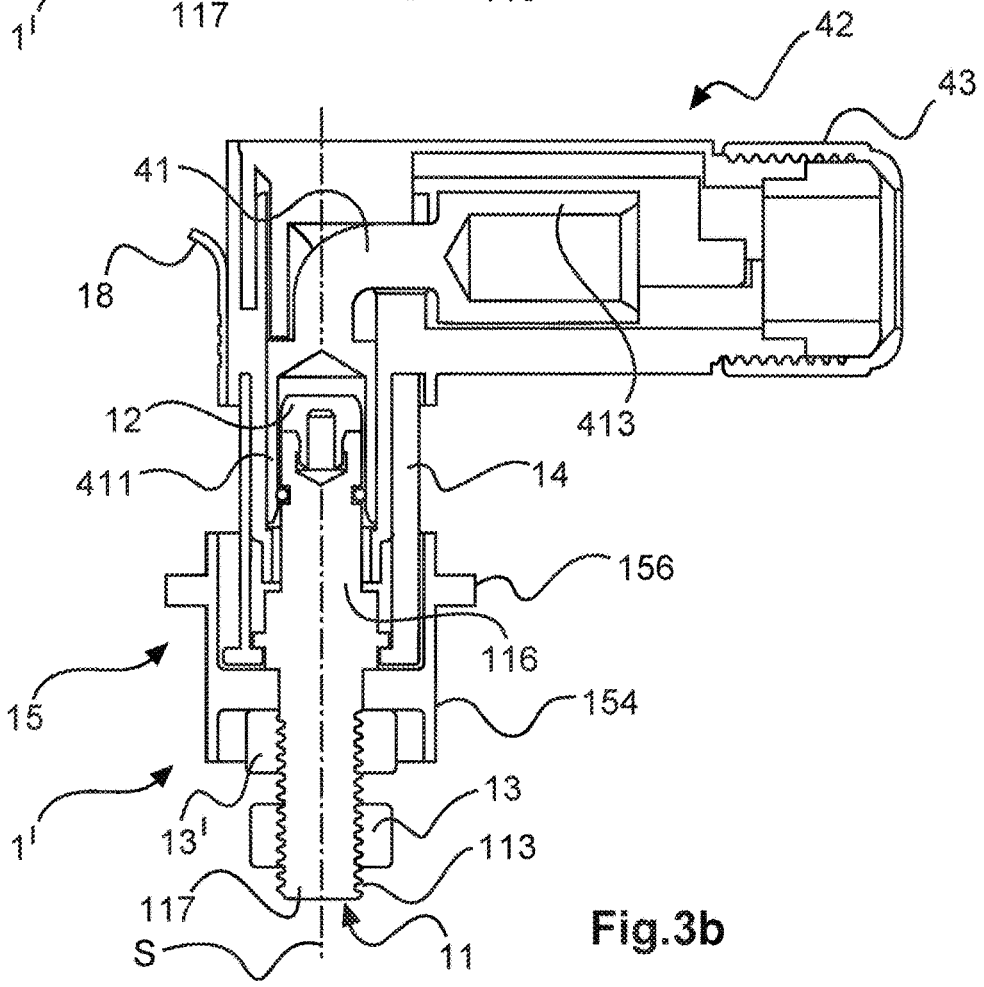

FIGS. 3*a* and 3*b* show a high-current plug connector system, having the above-mentioned high-current plug connector 1' and a mating plug connector 4. The mating plug connector 4 is inserted into the high-current plug connector 1' by means of its mating plug-in region 441 (thus not visible in this illustration) of its mating insulating body 44 and locked on the locking clip 18 thereof by means of its locking pin 443. In this case, the locking clip 18, which is swiveled into its locking position, reaches over the locking pins 443 of the mating plug connector 4.

The mating plug connector 4 is an angled plug connector, i.e. it has a cable outlet 42 which is angled away from its mating plug-in region 441. In the present example, the cable outlet 42 is angled through 90° from the mating plug-in region 441, although other angular positions are also possible. The use of angled plug connectors essentially has the advantage of saving on space in the mating direction. In this case, the cable outlet 42 is composed of a separate holding plate 421 and a cable-connection-side part of the mating insulating body 44, which is angled away from the mating plug-in region 441.

In the present case, however, the insulating body 14 of the high-current plug connector 1 is rotatably mounted and can therefore be rotated about the plug contact axis S despite the fastening of the pin contact 11 and possibly the mounting housing 15. Since the locking clip 18 is not held on the mounting housing 15—as is conventionally the case—but on the rotatable insulating body 14, the mating plug connector 4 with its angled cable outlet 42 can also be easily rotated about the plug contact axis S.

In another embodiment, the locking clip 18 can be held on the mating plug connector 4 such that it is capable of swiveling and can latch on the insulating body 14 of the high-current plug connector 1'. The important factor here is that the mating plug connector 4 is fixed by locking on the insulating body 14 and not on the mounting housing 15.

The mating plug contact 4 has a mating plug contact in the form of a socket contact 41. This likewise has an angled design. Its plug-in region is designed as a contact socket 411, and can be mated with the contact pin 116 of the pin contact 11, as can clearly be seen in FIG. 3*b*.

The mating plug connector 4 furthermore has a cable gland 43 at its cable outlet 42 for strain relief and for sealing a cable connected thereto. This is only mentioned for the sake of completeness.

Figure 3C:
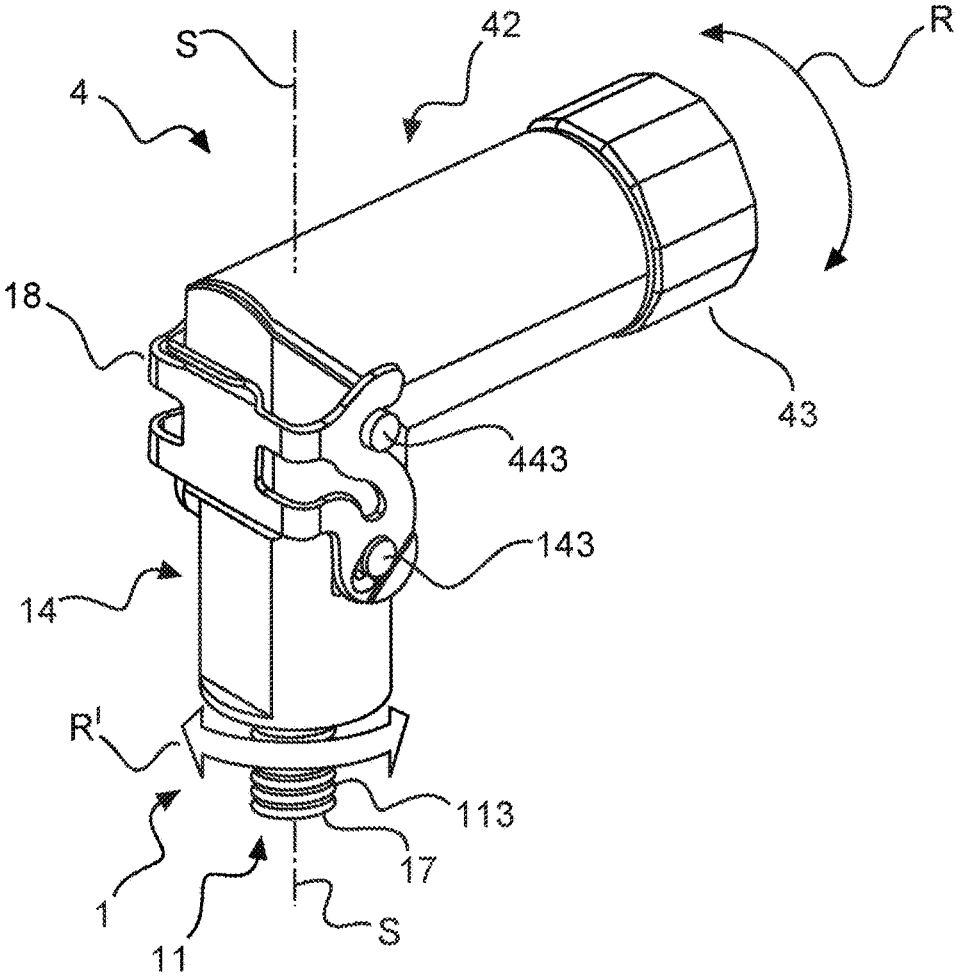
FIG. 3*c* shows the mated high-current plug connector system without the mounting housing in an oblique plan view.
Figure 3D:
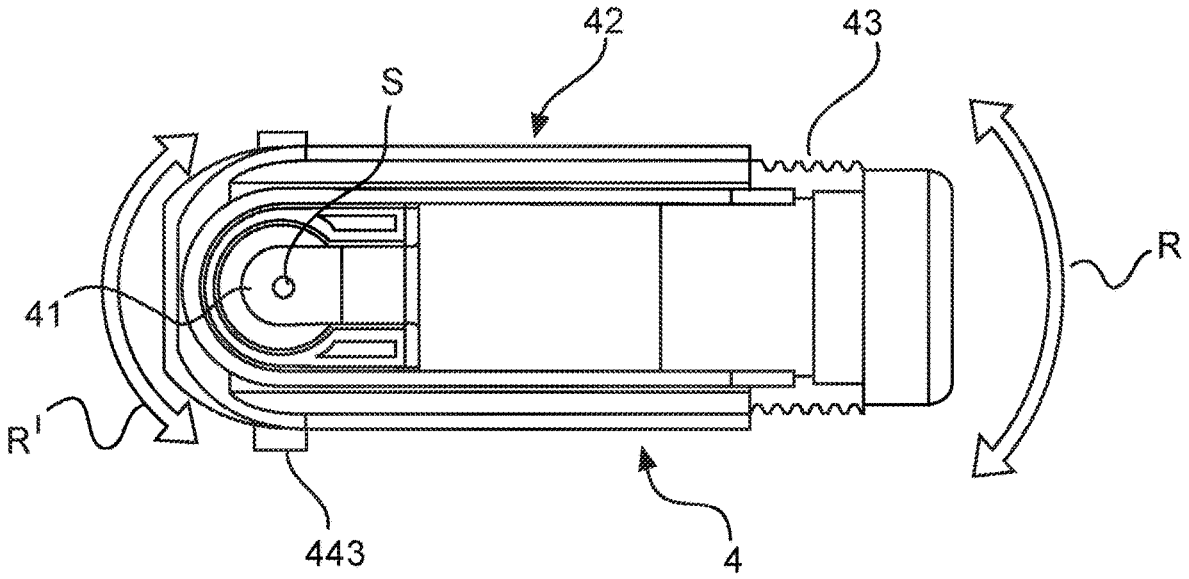
FIG. 3*d* shows the above-mentioned arrangement without a holding plate in a plan view.

FIGS. 3*c* and 3*d* shows a similar device from different perspectives for the first-mentioned high-current plug connector 1, which does not have a mounting housing 14. In this case, the insulating body 14 is merely rotatably held on the pin contact 11. The pin contact 11 can be screwed onto a busbar of the electrical device, for example, by means of the external thread 113 of its connection region 117 and can thus be mechanically fixed on said busbar and electrically connected thereto.

The insulating body 14 is held on the pin contact 11 such that it is rotatable about the mating axis S. The curved double-headed arrows R, R' symbolize the respective, thus-enabled, rotational or pivoting movement about the plug contact axis S. In particular, the first curved double-headed arrow R shows the rotational movement which can be executed by the cable outlet 42 of the mating plug connector. The second curved double-headed arrow R' symbolizes the associated rotational movement of the insulating body 14 about the plug contact axis S.

FIG. 3*c* shows the entire high-current plug connector system in the mated and locked state in an oblique plan view.

FIG. 3*d* shows the high-current plug connector system without the holding plate 42 in a vertical plan view. The cable connection region 413 of the socket contact 41 is visible due to the holding plate 42 being omitted.

FIGS. 4*a*-4*d* show the angled mating plug connector 4 in different views, namely an oblique side view, a front view, a side view and an oblique plan view.

The mating plug connector 4 has a holding plate 421 and a mating insulating body 44.

At its mating-side end, the mating insulating body 44 has a mating plug-in region 441 with a mating polarization element in the form of a planar mating polarization portion 446. Opposite this mating polarization portion 446, the mating plug-in region 441 has a coding recess 445 as a mating coding element. A hollow cylindrical socket touch protection 442 is integrally formed on the mating plug-in region 441. This touch protection has a plug contact opening 440, which, in FIG. 4*a*, enables the outermost end of the contact socket 411 of the mating plug contact 41 designed as an angled socket contact 41 to be seen.

Figure 4A:
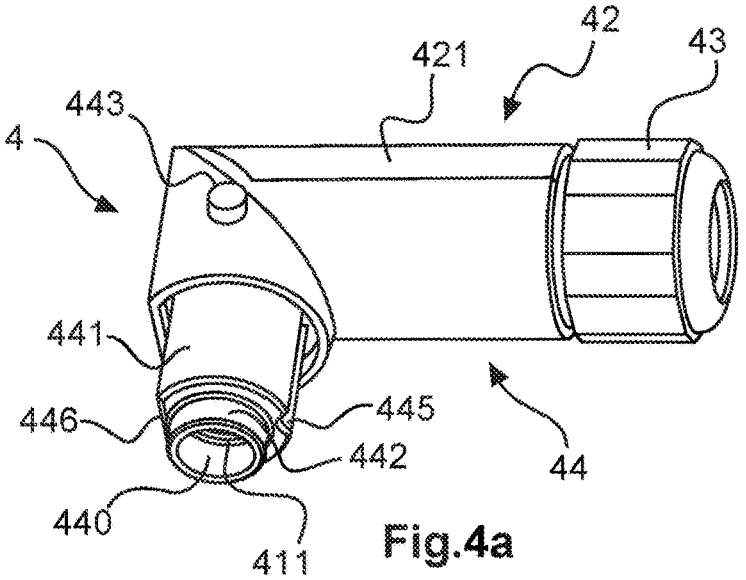
FIGS. 4*a*-4*d* show the angled mating plug connector in various views.
Figure 4B:
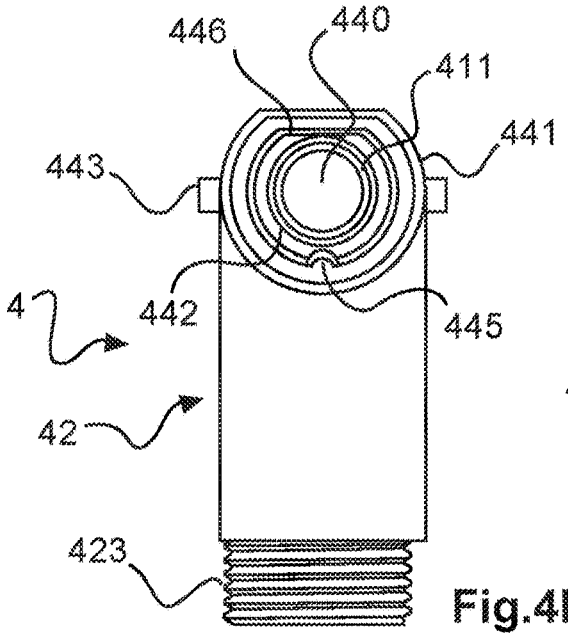
Figure 4C:
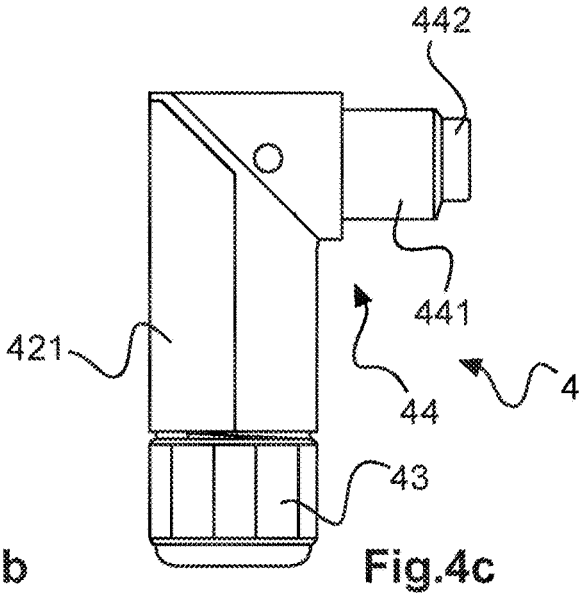
Figure 4D:
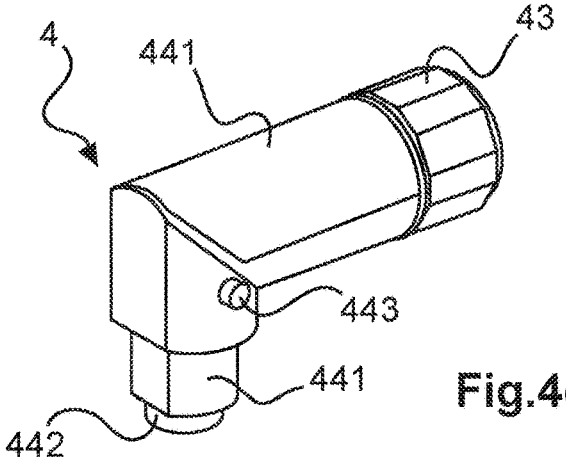
Figure 4E:
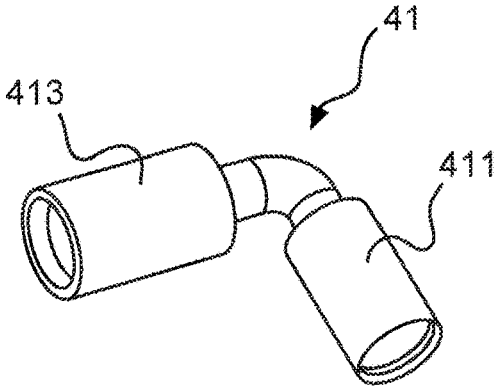
FIG. 4*e* shows the angled socket contact of the mating plug connector.

FIG. 4*e* shows the angled socket contact 41, the cable connection region 413 of which is designed as a crimp connection. In this case, the cable connection region 413 and the said contact socket 411 are arranged at a right angle to one another.

Figure 4F:
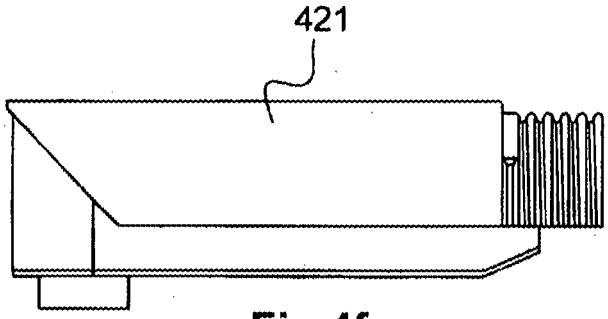
FIG. 4*f* shows a holding plate of the mating plug connector in a side view.

FIG. 4*f* shows the said holding plate 421 in a side view.

Figure 4G:
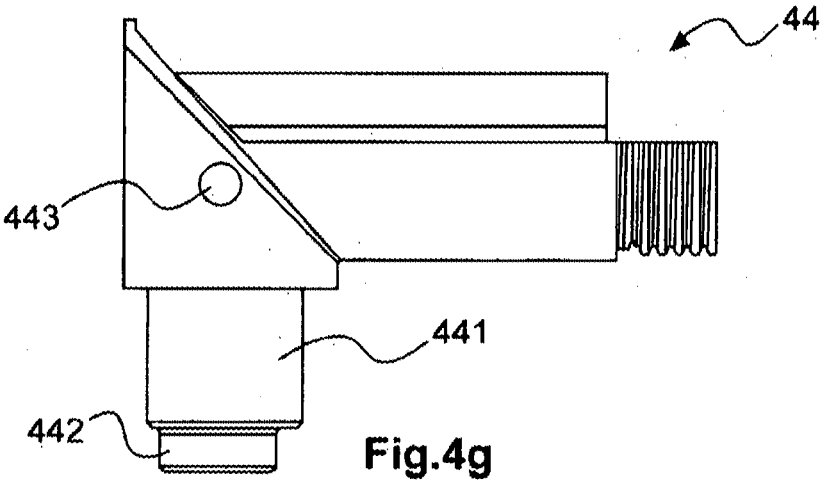
FIGS. 4*g*-4*h* show a mating insulating body of the mating plug connector from a side view and in an oblique plan view.
Figure 4H:
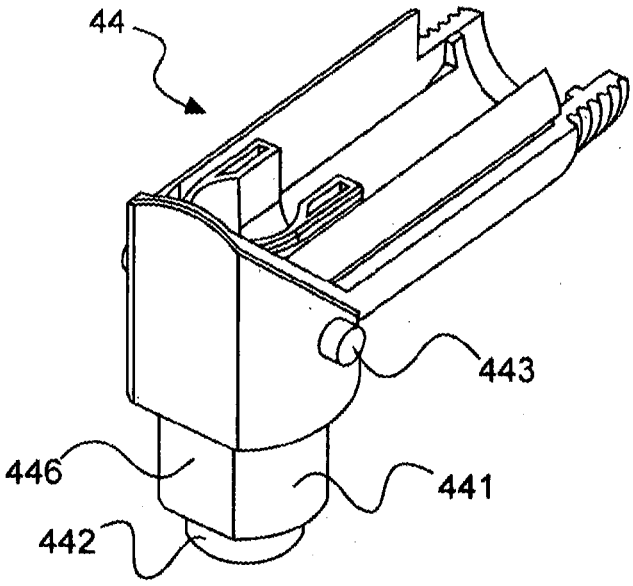

FIGS. 4*g* and 4*h* show the mating insulating body 44 in an oblique plan view.

FIGS. 5*a*-5*d* show various codings of the insulating body 14 of the high-current plug connector 1, 1'.

Figure 5A:
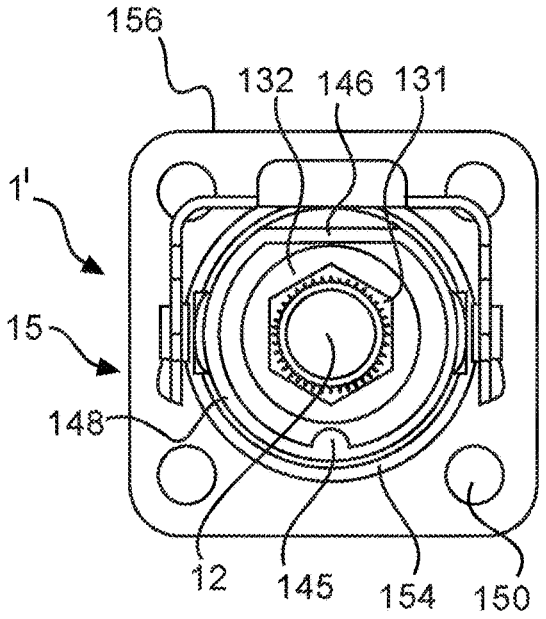
FIGS. 5*a*-5*d* show the high-current plug connector with and without a mounting housing with three different codings.

FIG. 5*a* shows the further high-current plug connector 1' with the mounting housing 15 and its fastening flange 156. In this case, the contact pin 116 of the pin contact 11 is concealed by the touch protection 12 placed thereon. However, the screw-nut portion and the plate-shaped separating collar are clearly visible in this illustration. The pin contact 11 is fastened on the electrical device (not illustrated) by means of its thread 113, and the mounting housing 15 is fastened on the said electrical device by means of its fastening flange 156. The pin contact 11 and the mounting housing are therefore in a fixed position with respect to one another.

The insulating body 14, of which only the circumferential collar 148 is visible in this illustration, has, on this circumferential collar 148, the polarization portion 146 (illustrated at the top in the drawing) and, opposite this, the inwardly directed coding molding 145.

Figure 5B:
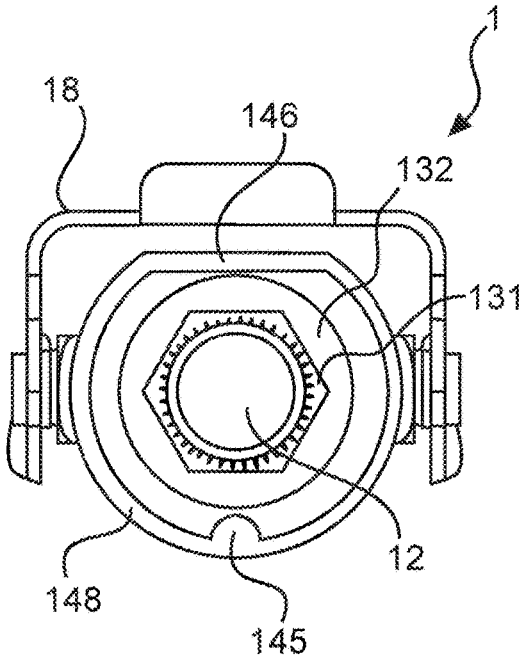
Figure 5C:
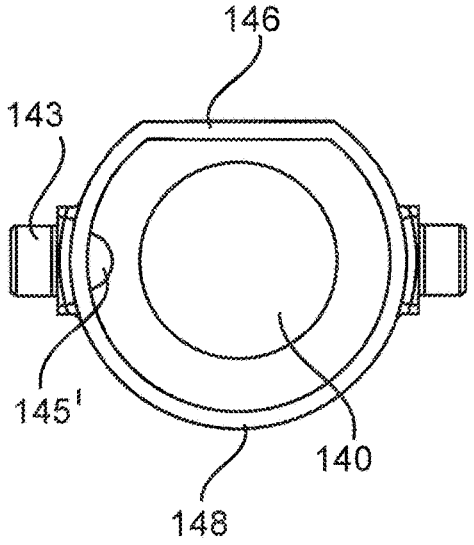
Figure 5D:
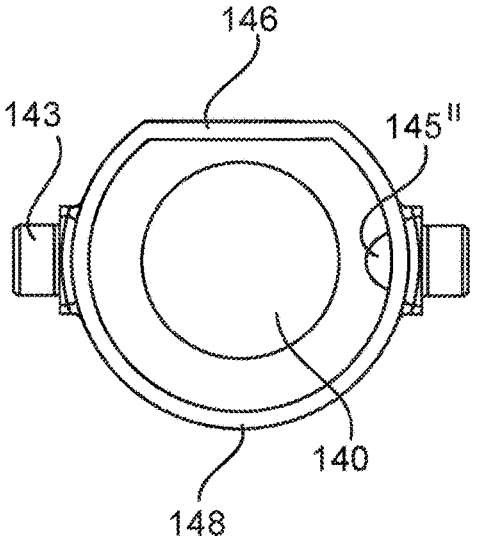

In FIG. 5*b*, the high-current plug connector 1 is illustrated on an enlarged scale without the mounting housing 15.

In other embodiments, the respective coding moldings 145', 145" are each located on a different region of the circumferential collar 148, whereby a different coding is then produced in each case. For example, an angular spacing of 90° in each case is also possible, as shown by way of example in FIGS. 5*c* and 5*d*. The respective coding molding

145', 145" is then located on the axis of rotation D. It goes without saying that a plurality of further angular spacings for a different coding is also possible, so that a very high number of different codings is possible.

It is clear from this illustration that the actual coding is produced by the relative position between the respective coding element 145 or mating coding element 445 and the polarization element or mating polarization element 146.

In the present embodiment, this is implemented as follows: In the case of the high-current plug connector, this relative position is formed between the coding molding 145 and the polarization portion 146; in the mating plug connector, it is formed between the polarization recess 445 and the mating polarization portion 446.

If these relative positions coincide with one another, the high-current plug connector 1, 1' can be mated with the mating plug connector 4. Moreover, the mating plug connector 4 with its angled cable outlet 42 can be aligned in a flexible manner.

Even where combinations of different aspects or features are shown in the figures in each case, it is clear to a person skilled in the art—unless indicated otherwise—that the combinations shown and discussed are not the only possible combinations. In particular, mutually corresponding units or feature complexes from different exemplary embodiments can be interchanged with one another.

LIST OF REFERENCE SIGNS

1, 1' High-current plug connector
11 Plug contact, pin contact
113 Screw thread, external thread
12 Touch protection
13, 13' Screw-nuts
131 Screw-nut portion
132 Plate-shaped separating collar
116 Plug-in region, contact pin
117 Connection region
118 Contact spring, annularly designed helical spring
14 Insulating body
140 Cavity
143 Pivot pin
145, 145', 145" Coding element, coding molding
146 Polarization element, polarization portion
148 Circumferential collar
15 Mounting housing
150 Screw passages
154 Hollow cylindrical sleeve
156 Fastening flange
18 Locking clip
4 Angled mating plug connector
41 Mating plug contact, socket contact
411 Contact socket
413 Cable connection region, crimp connection
42 Cable outlet
421 Holding plate
43 Cable gland
44 Mating insulating body
440 Plug contact opening
441 Mating plug-in region of the mating insulating body
442 Socket touch protection
443 Locking pin
445 Mating coding element, coding recess
446 Mating polarization element, mating polarization portion
46 Mating insulating body
S Pin contact axis
R, R' Curved double-headed arrow, symbolizing the rotational/pivoting movement

The invention claimed is:

1. A high-current plug connector (1, 1') for installing and/or mounting in or on an electrical device and for mating with a mating plug connector (4) and for transmitting electrical energy to the mating plug connector (4), the high-current plug connector (1, 1') comprising:

an insulating body (14), which has a polarization element (146) for defining an alignment of the mating plug connector (4) on the insulating body (14) and a coding element (145) for preventing mismatings; and a plug contact (11) arranged in and/or on the insulating body (14) and having a plug-in region (116) and, opposite thereto, a connection region (117) with a screw thread (113), wherein the plug contact (11), by means of its screw thread, can be fixed on the electrical device and electrically contacted thereby, and wherein the insulating body (14) is at the same time held on the plug contact (11) such that it is rotatable about a plug contact axis (S) of the plug contact (11).

2. The high-current plug connector (1') as claimed in claim 1, wherein the high-current plug connector (1') further comprises a mounting housing (15), which has a fastening flange (156) with which it can be fixed on the electrical device, wherein the insulating body (14) is arranged in and/or on the mounting housing (15) and is held therein and/or thereon such that it is rotatable about the plug contact axis (S).

3. The high-current plug connector (1, 1') as claimed in claim 1, wherein the high-current plug connector (1, 1') has a locking clip (18), which is held such that it can swivel about an axis of rotation (D) for locking and unlocking the mating plug connector (4) on the insulating body (14) of the high-current plug connector (1, 1').

4. The high-current plug connector (1, 1') as claimed in claim 1, wherein the high-current plug connector (1, 1') has a coding, which is formed by a relative position of the coding element (145) and the polarization element (146).

5. The high-current plug connector (1, 1') as claimed in claim 1, wherein the insulating body (14) has a circumferential collar (148) and a cavity (140) formed thereby, into which the plug contact (11) projects with its plug-in region (116).

6. The high-current plug connector (1, 1') as claimed in claim 1, wherein the plug contact (11) has a circumferential groove in its plug-in region (116), in which groove a contact spring (118) is arranged for electrically contacting a mating plug contact (41) of the mating plug connector (4).

7. The high-current plug connector (1, 1') as claimed in claim 1, wherein the plug contact (11) has touch protection (12) at a free end of its plug-in region (116), which touch protection consists of an electrically insulating material.

8. The high-current plug connector (1, 1') as claimed in claim 1, wherein the plug contact (11), by means of its connection-side screw thread (13), can be screwed into or onto a busbar of the electrical device for fastening and electrical contacting purposes.

9. The high-current plug connector (1,1') as claimed in claim 1, wherein the plug contact is a pin contact (11) and wherein the plug-in region of the pin contact is formed by a contact pin (116).

10. The high-current plug connector (1,1') as claimed in claim 1, wherein the high-current plug connector (1, 1') has a single pole.

11. A high-current plug connector system, comprising:

the high-current plug connector (1, 1') as claimed in claim 1; and a mating plug connector (4) with an angled cable outlet (42).

12. The high-current plug connector system as claimed in claim 11, wherein the high-current plug connector (1, 1') and the mating plug connector (4) have a common coding via which they are defined as corresponding to one another and being mateable with one another.

13. The high-current plug connector system as claimed in claim 11, wherein the mating plug connector (4) has a mating insulating body (44) with a mating polarization element (446) for alignment on the insulating body (14) of the high-current plug connector (1).

14. The high-current plug connector system as claimed in claim 11, wherein, in a mated state, the mating plug connector (4) with its angled cable outlet (42) is held such that it is rotatable about the plug contact axis (S) of the high-current plug connector (1, 1').

15. The high-current plug connector system as claimed in claim 13, wherein a coding on the high-current plug connector consists in a coding molding (145) of a circumferential collar (148) of the insulating body (14) in conjunction with its position relative to the said polarization element (146) and wherein a coding on the mating plug connector consists in a coding recess (445) matching the said coding molding (145) of a mating insulating body (44) of the mating plug connector (4) in conjunction with its position relative to a mating polarization element (446) of the mating plug connector (4), wherein the high-current plug connector (1, 1') and the mating plug connector (4) are coded as corresponding to one another when these two relative positions coincide.

16. The high-current plug connector system as claimed in claim 11, wherein the plug contact is a pin contact (11) and a mating plug contact is a socket contact (41).

* * * * *